US011447207B2

(12) United States Patent
Valverde et al.

(10) Patent No.: US 11,447,207 B2
(45) **Date of Patent: *Sep. 20, 2022**

(54) BOAT HULL DRAIN PLUG

(71) Applicant: Proxamus LLC, The Woodlands, TX (US)

(72) Inventors: Eduardo Valverde, The Woodlands, TX (US); Timothy P. Beaton, Montgomery, TX (US); Scott Wood, Fort Lauderdale, FL (US)

(73) Assignee: Proxamus LLC, The Woodlands, TX (US)

( * ) Notice: Subject to any disclaimer, the term of this patent is extended or adjusted under 35 U.S.C. 154(b) by 17 days.

This patent is subject to a terminal disclaimer.

(21) Appl. No.: 16/950,858

(22) Filed: Nov. 17, 2020

(65) Prior Publication Data

US 2021/0061417 A1 Mar. 4, 2021

Related U.S. Application Data

(63) Continuation of application No. 16/197,903, filed on Nov. 21, 2018, now Pat. No. 10,836,455.

(60) Provisional application No. 62/589,846, filed on Nov. 22, 2017.

(51) Int. Cl.
*B63B 13/00* (2006.01)
*B63J 99/00* (2009.01)

(52) U.S. Cl.
CPC ..... *B63B 13/00* (2013.01); *B63J 99/00* (2013.01)

(58) Field of Classification Search
CPC ..... B63B 13/00; B63J 99/00
See application file for complete search history.

(56) References Cited

U.S. PATENT DOCUMENTS

| | | | | |
|---|---|---|---|---|
| 2,990,798 | A * | 7/1961 | Pribyl | B63B 13/00 114/183 R |
| 3,029,768 | A * | 4/1962 | Spurlock | B63B 13/00 251/322 |
| 3,896,280 | A * | 7/1975 | Blake | F16K 37/0041 137/554 |
| 4,019,454 | A | 4/1977 | Landwerlen | |
| 5,966,080 | A * | 10/1999 | Bigsby | B63J 99/00 340/687 |
| 6,035,702 | A | 3/2000 | Graham | |
| 6,615,760 | B1 * | 9/2003 | Wise | F16K 15/04 114/197 |
| 10,836,455 | B2 * | 11/2020 | Valverde | B63B 13/00 |
| 2018/0127961 | A1 * | 5/2018 | Homami | E03C 1/2306 |

OTHER PUBLICATIONS

USPTO Non-Final Office Action for U.S. Appl. No. 16/197,903 dated Jan. 2, 2020.
USPTO Notice of Allowance for U.S. Appl. No. 16/197,903 dated Jun. 23, 2020.

* cited by examiner

*Primary Examiner* — Stephen P Avila
(74) *Attorney, Agent, or Firm* — Tumey L.L.P.

(57) ABSTRACT

A drain plug for a recreational boat includes a position sensor and an alarm to detect the operating condition of the drain plug and provide a signal indicating that the plug is in an open position. The drain plug includes a drain plug body and a cap. The cap is connected to the drain plug body in such a manner as to be inseparable from the drain plug body.

18 Claims, 3 Drawing Sheets

BOAT HULL DRAIN PLUG

This application claims priority to provisional application Ser. No. 62/589,846 filed Nov. 22, 2017, and is a continuation of non-provisional application Ser. No. 16/197,903 filed Nov. 21, 2018, the entire contents of which are hereby incorporated herein by reference hereto.

BACKGROUND OF THE INVENTION

Field Of The Invention

This invention is directed to a drain plug for the bilge area of a boat. Recreational boats including motor and sail boats are normally fitted with a drain plug to drain water from the bilge area of the boat. These drain plugs are commonly referred to as garboard plugs.

Description Of Related Art

Drain plugs are used on all types of boats to allow water to drain out of the hull or bilge after being pulled from the water onto a trailer. Boaters frequently overlook reinstalling the drain plug when launching at boat ramps. Because the plug becomes separated from the garboard, the plug can often be lost or misplaced aggravating the problem.

All conventional drain plugs currently installed on pleasure boats rely solely on human detection and discretion. These plugs sometimes require tools to open or close and the plug can become lost or misplaced when removed.

This invention detects when the drain cavity is open, is ergonomically designed to be easily operated by hand, and the cap/plug stays attached when in open position.

BRIEF SUMMARY OF THE INVENTION

The invention disclosed herein includes a drain plug body having multiple flow passages and a stem portion. The drain plug body is adapted to be secured to a boat transom or other support.

The stem portion extends into the bilge area and includes a sensor switch which is wired to an alarm or other indicator.

An internally threaded cap is attached to the drain plug body and includes a shaft adapted to reciprocate in the hollow stem portion of the drain plug body. The shaft is fixedly attached to the cap and includes a stop member which prohibits the cap from being separated from the drain plug. A spring and magnet are also located within the hollow stem portion of the drain plug body. If the plug is in the open position, the switch will be closed and a warning device will be activated by the power source when the ignition is turned on. Conversely, when the magnet is moved in proximity to the switch, the switch will be open and the alarm device will be deactivated.

DETAILED DESCRIPTION OF THE INVENTION

Figure 1:
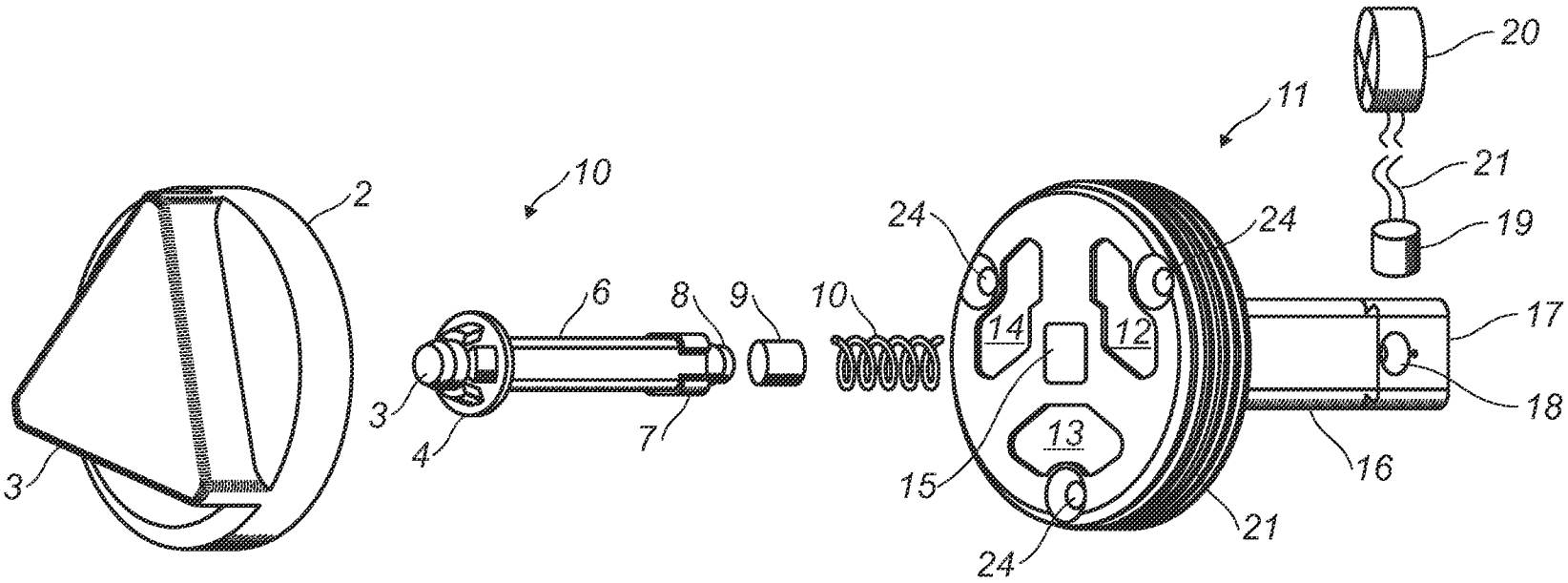
FIG. 1 illustrates an exploded view of an embodiment of the invention.

As shown in FIG. 1, the drain plug 10 includes a drain plug body 11 having a hollow stem portion 16 which includes a cavity 18 located in detachable closed end portion 17 of the stem adapted to hold a sensor 19 which may be for example a reed switch. Sensor 19 is connected to an alarm 20 which may be of the audible or visible type. Drain plug body 11 includes NPF type threads and include a central bore 15 that extends through stem portion 16. Main plug body 11 also includes a plurality of through passage 12, 13, 14 which communicate with the bilge area 51 when the drain plug is installed on the transom 54. Holes 24 are provided for attaching the drain plug body to the boat transom and a flat sealing member 23 may be positioned between the boat transom and a back surface of the drain plug body. Drain plug body 11 is positioned around the existing drain hole in transom 54. The flow area through the main plug body should be greater than 0.2 square inch.

Cap 2 is internally thread at 31 with NPT threads and includes a triangular knob 3. Shaft 6 is fixedly retained in cap 2 by an end portion 5 that snap fits into a ring member 4 that is secured to the cap in an internal cavity not shown. Shaft 6 and stem 16 may be circular or rectangular in cross section.

A retainer ring 7 is fixed to shaft 6 and cooperates with a stop shoulder within bore 15 of the drain plug body in the assembled configuration.

Figure 2:
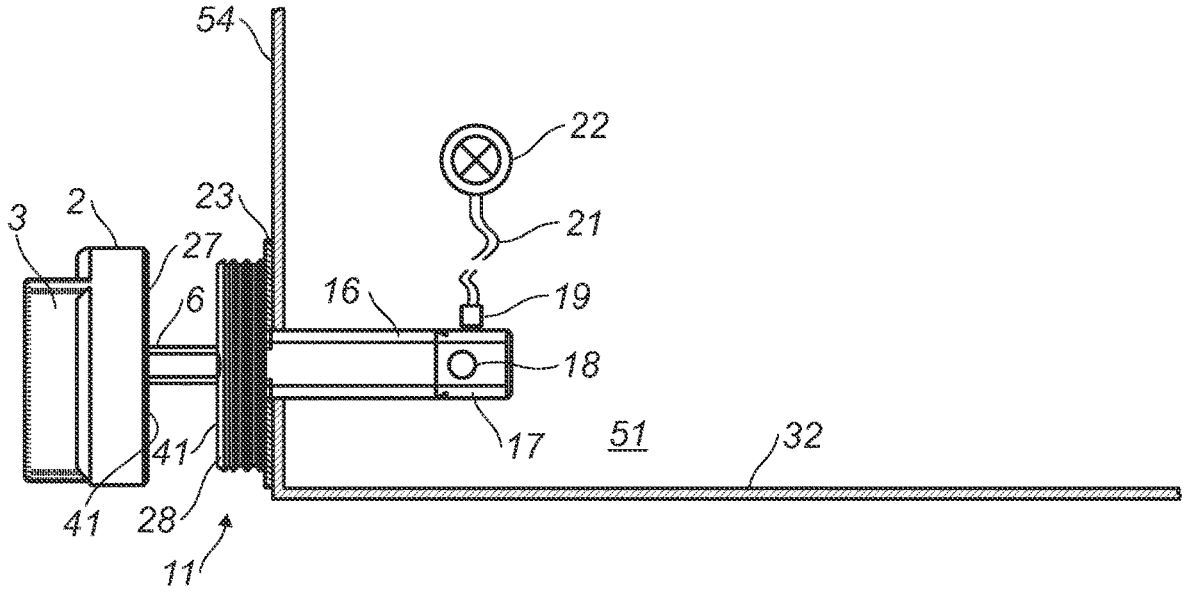
FIG. 2 is a plane view of the drain plug in the open position installed on a boat.
Figure 3:
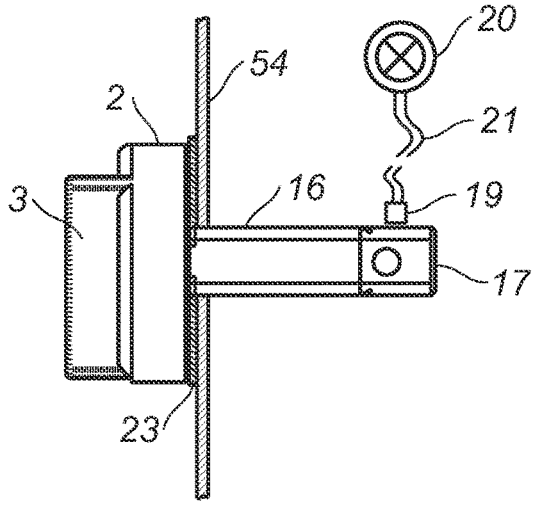
FIG. 3 is a view of the drain plug in the closed position.

A coil spring 10 and a magnet 9 are located within bore 15 in the assembled positioned shown in FIGS. 2 and 3.

In the open position of FIG. 2 liquid from bilge area 51 is free to pass through passages 12-14 into the ambient. Spring 10 separates magnet 9 from the general area of sensor 19.

Figure 4:
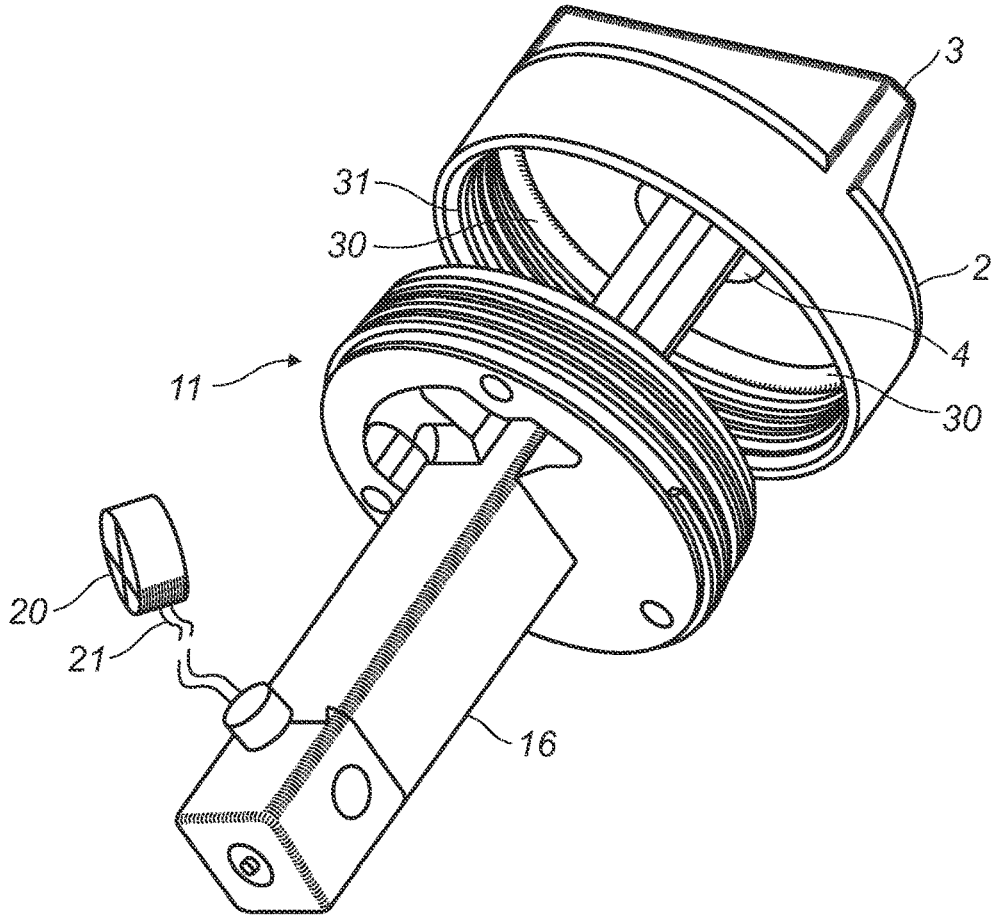
FIG. 4 is a view of the drain plug in an open position.

Retainer ring 7 prevents cap 2 from separating from drain plug body 11. To close the valve, cap 2 is rotated by grasping knob 3 so that an inner face of the cap comes into contact with front face 28 of the drain plug body thereby closing passages 12-14. An O-ring 30 may be positioned within cap 2 as shown in FIG. 4 to improve the seal. In the closed position spring 10 is compressed and magnet 5 is in close proximity to the switch thereby closing it. As shown in FIG. 2, in the open position cap 2 is separated from drain plug body 11 by a distance 41.

Figure 5:
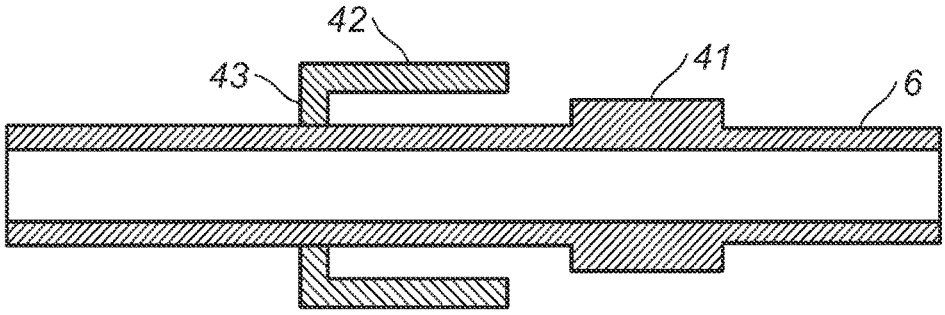
FIG. 5 is a cross sectional view of a stop mechanism for the cap.

Alternatively as shown in FIG. 5 the exterior surface of shaft 6 may be provided with an annular raised ring 41 which is located within bore 15 in the assembled position. A retainer cap 42 having an internal shoulder 43 is secured in bore 15 at rear face 28 of the drain plug body. Once assembled the internal shoulder 43 of the retainer cap will prevent shaft 6 from separating from the drain plug body by engaging the raise annular ring 41.

Although the present invention and its advantages have been described in detail, it should be understood that various changes, substitution and alterations may be made herein without departing from the spirit and scope of the invention as defined by the appended claims.

What is claimed is:

1. A drain plug comprising;

a) a drain plug body having at least one flow passage, a stem, and external threads, wherein the at least one flow passage communicates with a bilge area, b) a cap including internal threads that are configured to engage with the external threads, and a shaft fixedly secured to the cap and adapted to reciprocate within the drain plug body, and c) a spring positioned within a hollow portion of the stem that is configured to be compressed by the shaft when the drain plug is in a closed position.

2. The drain plug as claimed in claim 1, further including a retaining member fixed to the shaft to prevent the shaft from being separated from the drain plug body when the drain plug is in an assembled condition.

3. The drain plug as claimed in claim 1, wherein the cap includes a raised knob.

4. The drain plug as claimed in claim 1, further including an O-ring located within the cap.

5. The drain plug as claimed in claim 1, further including a sealing member adapted to be positioned between a rear surface of the drain plug body and a wall of a boat.

6. The drain plug as claimed in claim 1, wherein the drain plug body includes a plurality of flow passages.

7. The drain plug as claimed in claim 1, further including means for detecting the position of the cap relative to the drain plug body.

8. The drain plug as claimed in claim 1, further including a magnet within the hollow portion of the stem, wherein position of the magnet within the hollow portion of the stem is moved by the spring.

9. A drain plug comprising;

a) a drain plug body having at least one flow passage, a stem, and external threads, wherein the at least one flow passage communicates with a bilge area, b) a cap including internal threads that are configured to engage with the external threads, and a shaft fixedly secured to the cap and adapted to reciprocate within the drain plug body, c) a spring positioned within a hollow portion of the stem that is configured to be compressed by the shaft when the drain plug is in a closed position, d) a magnet positioned within the hollow portion of the stem, and e) a sensor.

10. The drain plug as claimed in claim 9, further including a detachable closed end portion.

11. The drain plug as claimed in claim 9, wherein the sensor is within a cavity located in the detachable closed end portion of the stem.

12. The drain plug as claimed in claim 9, wherein the sensor is connected to an alarm.

13. The drain plug as claimed in claim 12, wherein the alarm is an audible alarm.

14. The drain plug as claimed in claim 12, wherein the alarm is a visible alarm.

15. The drain plug as claimed in claim 9, further including an O-ring positioned within the cap.

16. The drain plug as claimed in claim 9, wherein the cap further includes a grasping knob for rotating the cap into the closed position.

17. The drain plug as claimed in claim 9, wherein the closed position comprises causing an inner face of the cap to come into contact with a front face of the drain plug body.

18. The drain plug as claimed in claim 9, wherein the magnet and the sensor are in close proximity when the cap is in the closed position.

* * * * *